United States Patent [19]

Taylor

[11] 4,121,659

[45] Oct. 24, 1978

[54] COLLAR LOCK AND SEAL ASSEMBLY FOR WELL TOOLS

[75] Inventor: Donald F. Taylor, Dallas, Tex.

[73] Assignee: Otis Engineering Corporation, Dallas, Tex.

[21] Appl. No.: 832,559

[22] Filed: Sep. 12, 1977

[51] Int. Cl.[2] ..... E21B 33/129

[52] U.S. Cl. ..... 166/129; 166/183; 166/217; 166/334

[58] Field of Search ..... 166/118, 138, 182, 183, 166/208, 217, 129

[56] References Cited

U.S. PATENT DOCUMENTS

| | | | |
|---|---|---|---|
| 2,975,836 | 3/1961 | Brown | 166/217 |
| 2,976,931 | 3/1961 | Daffin | 166/217 |
| 3,856,081 | 12/1974 | Canalizo | 166/217 |
| 4,023,620 | 5/1977 | Gazda et al. | 166/217 |
| 4,043,390 | 8/1977 | Glotin | 166/217 |

*Primary Examiner*—Ernest R. Purser
*Attorney, Agent, or Firm*—H. Mathews Garland

[57] ABSTRACT

A collar lock and seal assembly for releasably locking a well tool such as a pump in a well flow conductor, such as casing or tubing, and sealing with the flow conductor around the assembly to restrict flow to a path into the pump. The assembly has an annular support surface engageable with a no-go shoulder in the flow conductor, radially movable locking keys for expansion into a locking recess in the flow conductor above the no-go shoulder, a longitudinally operable bypass valve, and interference fit annular seals. First shear pins hold the assembly unlocked while running in and second shear pins are activated to lock the assembly at operating position. The seals and connected parts are coupled to resist rotation by the pump when locked in a well casing. In operation the assembly is coupled in a tool train including an electric well pump, valves, and related structure. The tool train is lowered on a cable in a well casing until the flow conductor no-go shoulder is engaged. The bypass valve allows lowering in a closed liquid filled system. Upon engagement with the no-go shoulder the keys are locked outwardly, the bypass valve is closed, and the seals form a pressure barrier around the assembly to limit flow into the pump and resist rotation of the assembly by the pump. The collar lock dog and seal assembly is unlocked for removal by a longitudinal upward force applied to the cable.

15 Claims, 7 Drawing Figures

COLLAR LOCK AND SEAL ASSEMBLY FOR WELL TOOLS

This invention relates to well tools and more particularly relates to a collar lock and seal assembly for use in releasably locking and sealing around a tool train in the casing of a well.

In the operation of wells, particularly oil wells, the natural formation pressure frequently is depleted to the level that it is necessary to supply energy to a formation in a well to continue removal of fluids such as oil from the well. It is common practice to use a submersible centrifugal pump supported below the liquid level in a well to pump the liquid to the surface. While such pumps may be supported on either a substantially rigid tubing string or from an electric cable, it is preferred that the cable be used for a number of reasons including space requirements at the surface end of the well. Submersible centrifugal pumps must be locked by some means within the casing of the well to hold them against rotation and against vertical movement in the well during operation. The locking arrangements on presently available pumps are not satisfactory for a number of reasons. Generally speaking, they are easily damaged during installation and frequently require such close tolerances within the well casing that deviations frequently encountered along a well prevent proper seating.

It is therefore a principal object of the invention to provide a new and improved assembly for locking well tools, particularly pumps, in a well casing.

It is another object of the invention to provide an assembly for releasably locking well tools in a well which also forms a seal with the casing around the well tools to direct flow along the casing through the tools.

It is another object of the invention to provide a collar lock and seal assembly for use in a well casing which releasably locks at an annular recess along the casing.

It is another object of the invention to provide an assembly of the character described which releasably locks at a no-go shoulder in a well casing.

It is another object of the invention to provide a collar lock and seal assembly which has a bypass valve permitting insertion of the assembly into a fluid filled closed system which valve is closed responsive to longitudinal movement only as the assembly is releasably locked in the well bore.

It is another object of the invention to provide a collar lock and seal assembly which resists rotation in a well casing when landed and locked in the casing.

It is another object of the invention to provide a collar lock and seal assembly for use with a well pump which when locked in a well casing is not dislodged from a seated locked position by pressure from below applied in an upward direction or fluid loads from above in a downward direction.

It is another object of the invention to provide a collar lock and seal assembly which includes shear pin structure activated upon locking the assembly in operating position to hold the assembly in such position until the pins are sheared to release the assembly for removal.

In accordance with the invention, there is provided a collar lock and seal assembly operable to releasably lock well tools such as a tool train including a well pump in the casing of the well bore. The assembly of the invention includes an inner tubular mandrel assembly providing a longitudinal flow passage through the assembly and having opposite end flanges for coupling the assembly at opposite ends into a tool train. Radially expandable and contractable locking keys are mounted on the mandrel for longitudinal movement along the mandrel relative to locking bosses on the mandrel between first release positions and second lock positions. An outer sleeve assembly is slidably mounted on the inner mandrel having a key retainer portion for holding the locking keys on the assembly, a lower end supprt shoulder for supporting the assembly on a no-go surface along a well casing, and external annular seal means forming an interference fit with a casing wall to seal against pressure both upwardly and downwardly. The mandrel and outer sleeve are provided with flow ports which are alignable at first relative positions of the mandrel and sleeve providing a bypass valve through the assembly and are misaligned at second relative longitudinal positions of the mandrel and sleeve closing the bypass valve through the assembly. First shear pins releasably connect the mandrel and sleeve at release positions during running in of the assembly while second shear pin structure is provided between the outer sleeve assembly and the mandrel activated when the assembly is landed and locked in the well casing for releasably locking the assembly at operating position. Set screws, connecting pins, and longitudinal slots cooperate for connecting the mandrel and outer sleeve assembly opposing relative rotation of the various parts of the assembly when landed and locked in a well casing.

A preferred embodiment of a collar lock and seal assembly constructed in accordance with the invention together with its objects and advantages will be better understood from the following detail description taken in conjunction with the accompanying drawings wherein.

Figures 1, 2, 3:
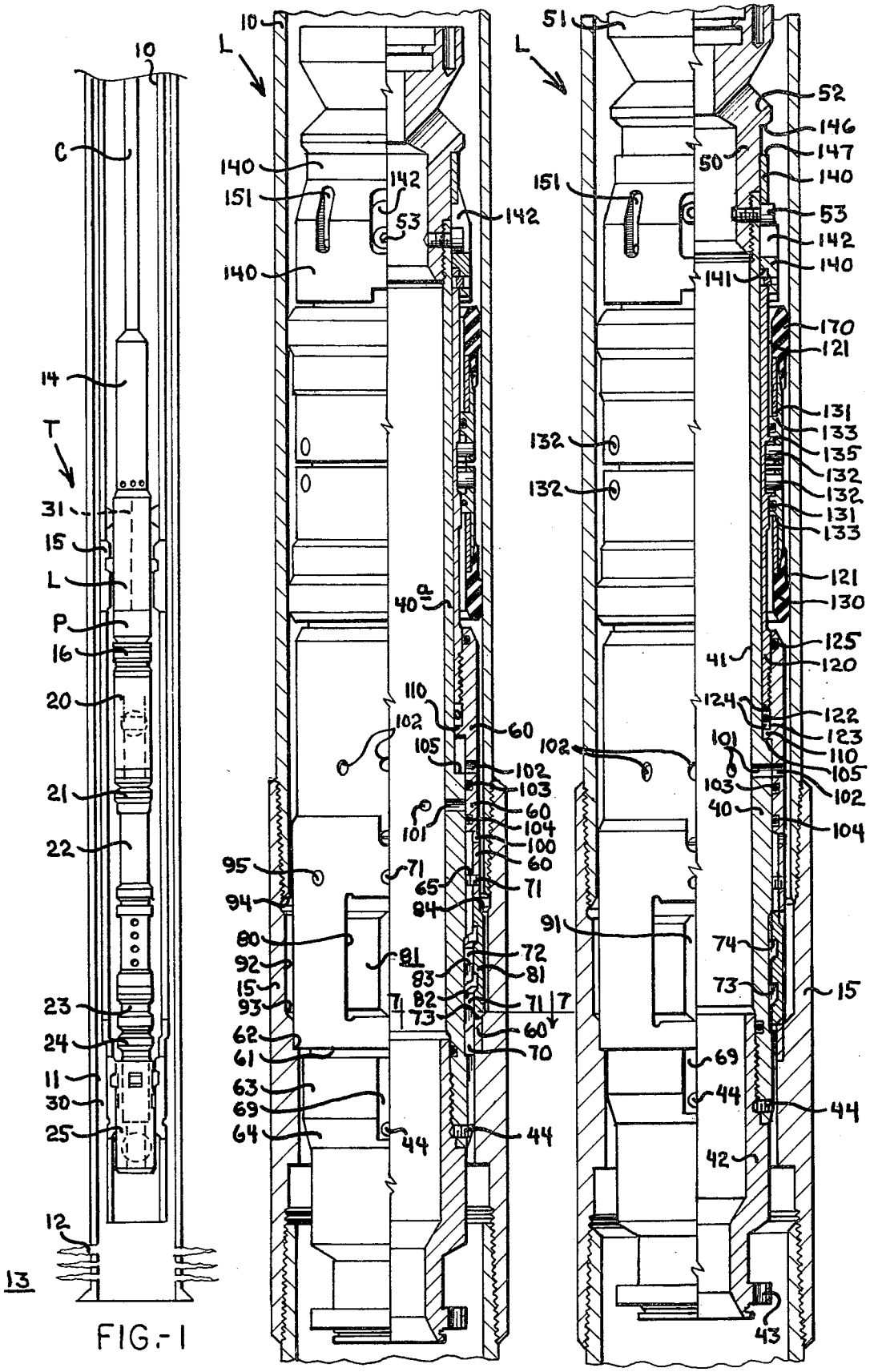
FIG. 1 is a longitudinal schematic view in elevation of a tool train including a well pump and related valve apparatus together with a collar lock and seal assembly in accordance with the invention releasably locked in a string of inner tubing or casing within another string of outer casing shown in cross-section.
FIG. 2 is a longitudinal view in section and elevation of a collar lock and seal assembly constructed in accordance with the invention illustrated in a locked position within the well tubing.
FIG. 3 is a longitudinal view in section and elevation of the collar lock and seal assembly shown in FIG. 2 illustrating the assembly in the released or unlocked condition.

Referring to FIG. 1, a tool train T which includes a collar lock and seal assembly L constructed in accordance with the invention and an electric pump P is suspended on a cable C within a well tubing 10 supported in a well casing 11. The casing 11 is perforated at 12 to permit entry of well fluids such as oil from a formation 13 surrounding the well casing. The tool train T also includes a Reda pump motor 14 which is directly connected with the cable C which is a Reda suspension cable having weight supporting and electrical power conducting capabilities. The lower end of the motor 14 is coupled with the upper end of the collar lock and seal assembly L. The pump P is a Reda submersible centrifugal electrical pump. The assembly L lands and locks at a Reda pump shoe 15 secured in and forming a part of the tubing 10 as shown in more detail in FIGS. 2 and 3. The Reda products including the motor 14, the pump P, and the pump shoe which is identifiable as a Reda pump shoe No. 28851-D are all available units manufactured and distributed by Reda Pump Division of Tracy-Ramey-Walridge Inc. of Bartlesville, Okla. The pump P is connected with a flex joint 16 which is secured with a hydraulic ball valve 20 connected with another flex joint 21 which is secured to an adjustable extension tubing 22. The extension tubing is connected with a flex joint 23 which is secured to a prong 24 which opens and closes a mechanical ball valve 25 releasably locked in a landing nipple 30 connected along a lower end portion of the tubing 10. All of the components of the tool train T beginning with the flex joint 16 and extended downwardly through the prong 24 and including the mechanical valve 25 and the landing nipple 30 are standard available equipment manufactured and sold by Otis Engineering Corporation, Dallas, Tex., and identified more specifically under the following serial numbers: flex joint 16 — Otis No. 546°°42; flex joints 21 and 23 — Otis Nos. 546°°43; hydraulic ball valve 20 — Otis No. 78°°139; extension tube 22 — Otis No. 75EO162; prong 24 — Otis No. 49°°7; mechanical valve 25 includes Otis lock mandrel 10RN52501, Otis equalizing valve 20RO52500, and Otis ball valves 78°°141; and landing nipple 30 — Otis No. 11RN52512. The Reda and Otis available equipment packages are shown and described for illustration only of a typical tool train which may be landed, locked and released by means of the collar lock and seal assembly of the invention and such Otis and Reda equipment forms no part of the invention.

The pump motor 14 and the pump P are connected to the opposite ends of the collar lock and seal assembly L and are coupled together so that the pump 14 drives the motor L by means of a shaft 31 which extends in between the motor and the pump through the central flow passage of the collar lock and seal assembly L. The various flex joints 16, 21 and 23 are provided to give the tool train flexibility so that it can traverse curved sections along a well tubing or casing. The adjustable extension tube 22 is provided to permit the length of the tool train between the collar lock L and the mechanical valve 25 at the landing nipple 30 to be adjusted to adapt the tool train to fit various wells in which the landing nipple or pump shoe 15 and the landing nipple 30 are at different distances apart.

Prior to the installation of the tool train T in the well tubing 10 for purposes of pumping the well, the well is equipped with and shut in by the mechanical ball valve 25 which is landed and locked in the landing nipple 30 in a conventional manner. The valve 25 is a normally closed ball safety valve which is opened by the prong 24 forming a part of the tool train 10 when the tool train is landed and locked in the well tubing. For installation and operation of the tool train T in a well equipped with the mechanical valve 25 at the lower end of the tubing 10 the tool train down through and including the prong 24 is assembled at the surface end of the well. The tool train is lowered into the well on the cable C with the prong 24 entering and opening the mechanical ball valve 25 to permit well fluids to flow upwardly into the pump P. The extension joint 22 having been previously adjusted to properly space the probe 24 from the collar lock L, when the probe enters and opens the mechanical valve 25, the collar lock and seal assembly L enters and locks in and seals with the shoe 15. While the prong opens the mechanical valve the hydraulic valve 20 remains closed until the pump P is placed in operation. The hydraulic ball valve 20 is designed to respond to the discharge pressure of the pump P so that when the pump P is placed in operation the fluid pressure developed by the pump opens the hydraulic ball valve 20 permitting upward flow through the tool train for pumping fluid to the surface in the tubing 10. When the pump is shut down the hydraulic ball valve 20 is designed to automatically close.

When pumping of the well is completed and the tool train is to be removed the train is pulled upwardly by the cable C releasing the collar lock and seal assembly L from the shoe 15 pulling the entire tool train including the pump 24 upwardly. As the prong 24 is retracted upwardly from the mechanical ball valve 25 the prong effects the closing of the ball valve to shut in the well.

The collar lock and seal assembly L effectively locks in the shoe 15 responsive to only longitudinal forces, forms a seal with the tubing above the shoe 15 forcing fluid flow through the pump and holding the tool train against a tendency to rotate in response to the operation of the pump thereby avoiding twisting and possible damage to the cable C.

The collar lock and seal assembly L of the present invention is illustrated in detail in FIGS. 2–7 inclusive. Referring particularly to FIG. 3, the assembly L has a mandrel 40 which is open at opposite ends and tubular in form defining a central bore 41 which forms a longitudinal flow passage through the assembly and accommodates the device shaft between the pump motor 14 and the pump P which as previously indicated are connected to opposite ends of the assembly L. At the lower end of the assembly a bottom sub 42 is threaded into the mandrel 40. The bottom sub has an external annular flange 43 permitting connection of the lower end of the assembly L with the pump P when assemblying the tool train shown in FIG. 1. The bottom sub 42 is locked against unthreading from the mandrel 40 by circumferentially spaced set screws 44 threaded through the mandrel into the bottom sub. An annular ring seal 45 in an internal annular recess of the mandreal 40 seals between the mandrel and the bottom sub 42. A top sub 50 is threaded into the upper end of the mandrel 40 and provided with a flange 51 which is connectable with the lower end of the pump motor 14. The top sub 50 has a discharge port 52 for discharge of fluid from the central bore 41 of the mandrel 40. The pump P discharges fluid into the bore 41 through the mandrel 40 and such fluid must flow outwardly into the tubing string from the mandrel at the top sub to pass upwardly around the motor 14 and cable C in the tubing string. The top sub 50 is locked against rotation relative to the mandrel 40 by circumferentially spaced socket head set screws 53 threaded through the mandrel 40 into the top sub. The set screws have large heads which perform an anti-rotation function as described hereinafter.

Figure 4:
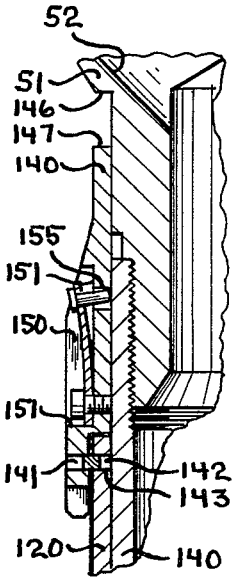
FIG. 4 is an enlarged fragmentary view in section showing the locking shear pin structure used in the assembly for releasably locking the assembly at operating position in a well, showing the shear pin structure as the assembly is run into the well.
Figure 7:
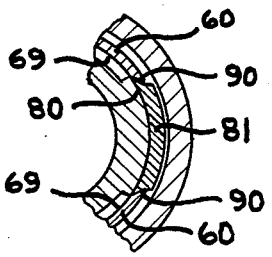
FIG. 7 is an enlarged fragmentary view in section showing the inner mandrel, locking key retainer sleeve, locking key, and landing nipple along the line 7—7 of FIG. 2.

Referring to both FIGS. 3 and 4, a key retainer 60 which is tubular in shape is slidably mounted on the mandrel 40 for supporting the collar lock and seal assembly in the shoe 15 and for retaining the locking keys which releasably lock the assembly in the pump shoe. The lower end edge 61 of the retainer sleeve 60 is a stop shoulder which engages an internal annular stop and supporting shoulder 62 within the pump shoe 15 for supporting the assembly in the pump shoe against downward movement. The retainer 60 telescopes over an enlarged portion 63 of the mandrel 40 which extends from a downwardly convergent surface 64 on the mandrel upwardly to an external annular stop shoulder 65 on the mandrel. The mandrel 40 along the enlarged portion 63 is provided with longitudinal outwardly opening slots 70 which extend from the tapered surface 64 upwardly along the enlarged mandrel surface 63 opening through the stop shoulder surface 65. The slots 69 serve a dual function of allowing fluid flow along this enlarged portion of the mandrel and receive the inward ends of socket head set screws 71 which are threaded through the retainer sleeve 60 into the slots to allow the retainer sleeve to slide on the mandrel 40 while preventing rotation between the retainer sleeve and the mandrel. Enlarged portion 63 of the mandrel 40 is also provided with longitudinally spaced external annular recesses 70, 71 and 72 as best illustrated in FIG. 2. Defined between the recesses 70, 71 and 72 are spaced external annular locking ribs or bosses 73 and 74 each of which is provided with a tapered lower end surface for camming one of the locking keys outwardly to the locking position. The lower end of the section of the enlarged portion 63 of the mandrel 40 above the recess 72 is similarly provided with a tapered camming surface. The retainer sleeve 60 has four circumferentially spaced windows 80 in each of which is positioned a locking key 81 adapted to expand and contract radially for locking and releasing the collar lock and seal assembly in a flow conductor. Each of the locking keys 81 has internal transverse longitudinally spaced locking surfaces 82, 83 and 84 which correspond in spacing, shape, and size with the recesses 70, 71 and 72 along the enlarged portion 63 of the mandrel 40. When the locking surfaces 82, 83 and 84 within each of the locking keys are aligned respectively with the recesses 70, 71 and 72 along the mandrel 40 the four locking keys may nest closely inwardly on the mandrel at the release positions represented in FIG. 3. When the locking surfaces 82, 83 and 84 within the keys are misaligned with the mandrel recesses 70, 71 and 72 the locking bosses 73, 74 and the portion of the mandrel above the recess 72 fit behind the keys 81, engage the key surfaces 82, 83 and 84 propping the keys outwardly at the locked positions as shown in FIG. 2. The locking keys 81 each has side flanges 90 which flare outwardly and inwardly behind side edges of the windows 80 as shown in FIG. 7 to retain the keys 81 around the mandrel within the windows preventing the keys falling out of the windows from the retainer sleeve 60 as they expand and contract upon relative movement between the mandrel and the retainer sleeve. Each of the keys also has a central longitudinal slot 91 along the outer surface of each key as a release space for fluid flow as needed to minimize any fluid deterrent to the entry and locking of the assembly in the pump shoe.

The pump shoe 15 is enlarged above the stop shoulder 62 defining a locking recess 92 extending from a lower inwardly converging cam surface 93 to a lower end edge 94 on the section of the tubing or casing 10 threaded into the upper end of the pump shoe. The keys 81 are sized to engage the locking recess when expanded as illustrated in FIG. 2 and to release from the recess when contracted as illustrated in FIG. 3. The opposite ends of the outer locking surfaces of the keys 81 have inwardly sloping cam surfaces which urge the keys inwardly when the keys are in release condition as in FIG. 3 so that the keys will pass and release from any recesses traversed by the collar lock and seal assembly as the assembly is run into and retrieved from a well.

The keys 81 are free to move radially inwardly and outwardly within the limits permitted by the spacing along the windows 80 of the retainer sleeve 60 and the mandrel 40 depending upon the relative longitudinal positions of the retainer sleeve 60 and the mandrel 40. At a first upper position of the mandrel 40 relative to the retainer sleeve 60 the expander ribs 73 and 74 are aligned with the internal transverse recesses along the keys 81 so that the keys nest at inward released positions on the mandrel as shown in FIG. 3. When the mandrel 40 is shifted downwardly relative to the retainer sleeve 60 as in FIG. 2, the mandrel ribs 73 and 74 are moved downwardly relative to the keys 81 propping the keys outwardly at the lock positions of FIG. 2. In the running condition of the assembly L as in FIG. 3 shear screws 95 threaded through the retainer sleeve 60 into the mandrel 40 hold the mandrel and the shear sleeve together longitudinally at the position at which the keys 81 are free to move inwardly to the release positions of FIG. 3. In the particular embodiment of the assembly L illustrated four set screws 71 are circumferentially spaced at 90° intervals around the assembly holding the retainer sleeve and the mandrel against rotation relative to each other while permitting relative longitudinal movement between the parts inasmuch as the set screws 71 have inward end portions which slide along longitudinal slots 69 which are equally spaced at 90° intervals around the mandrel. Four of the shear screws 95 also spaced at 90° intervals around the assembly and equally spaced between the guide set screws 71 are used to releasably hold the retainer sleeve 60 and the mandrel 40 together in the key release condition of FIG. 3 when running the assembly into a well. The retainer sleeve 60 has circumferentially spaced ports 100 which open through the sleeve into the space between the sleeve and the mandrel upwardly of the set screws 71 for fluid release between the parts to minimize trapping of fluid which might hinder the free movement of the parts and their telescoping relation during the locking and release of the assembly in a well.

A bypass flow passage is defined between the interior and exterior of the collar lock and seal assembly L by ports 101 in the mandrel 40 and 102 in the retainer sleeve 60. Several circumferentially sets of the ports 101 and 102 are spaced around the mandrel and sleeve to allow free flow of fluid in a well bore between the exterior and interior of the assembly so that the assembly may be freely moved into and out of a liquid filled system. The bypass ports 101 and 102 are aligned with each other in the release condition of the assembly as shown in FIG. 3 and are misaligned when the mandrel and retainer sleeve are shifted longitudinally at the lock position of the parts as shown in FIG. 2 to close the bypass flow passages between the interior and exterior of the tool. The retainer sleeve 60 carries longitudinally spaced internal O-ring seals 103 and 104 which seal around the mandrel 40 within the sleeve on opposite sides of the mandrel ports 101 so that the bypass flow passages are closed in the lock condition of the assembly as shown in FIG. 2 when the mandrel 40 is shifted downwardly relative to the retainer sleeve 60. The mandrel 40 is reduced in diameter along an upper portion 40*a* and provided with an upwardly facing external annular stop shoulder 105 which is engageable with an internal annular flange 110 provided within the sleeve 60 which limits the downward position of the sleeve onto the mandrel at the release condition of the assembly as shown in FIG. 3.

The upper end of the retainer sleeve 60 is threaded on the lower end portion of a packer cup or seal support sleeve 120 which supports a pair of identical upwardly and downwardly facing packer cup or seal assemblies 121 for forming a fluid tight seal around the assembly L with the inner wall surface of the tubing of casing 10 sealing the annulus around the assembly against flow both upwardly and downwardly and holding the assembly against rotation within the well. A ring seal 122 within an internal recess 123 of the retainer sleeve 60 between a pair of backup rings 124 forms a sliding seal with the outer surface of the section 40*a* of the mandrel to seal between the mandrel and the sleeve 60 above the bypass ports 101 and 102 to prevent any fluid flow between the parts as they move longitudinally relative to each other during running and pulling of the tool. Similarly, a ring seal 125 is confined between the upper end of the sleeve 60 and the sleeve 120 to prevent fluid leakage along the threaded connection between the two sleeves.

The packer cups 121 are each formed of an annular flexible seal ring 130 made of a suitable rubber or synthetic material which is inert to well fluids and will form a fluid tight seal with an internal conduit wall surface such as that of the tubing 10. The seal ring 130 is mounted on a rigid ring 131 which is held on the mounting sleeve 120 by a plurality of circumferentially spaced pins 132. An internal ring seal 133 fits within the ring 131 sealing between the ring 131 and the outer surface of the mounting sleeve 120. Referring to both FIGS. 3 and FIG. 5 the pins 132 are pressed tightly in the mounting rings 131 of the upper and lower packer cups 121 with the inward end portions of each longitudinally aligned pair of pins in the upper and lower cups extending into longitudinal oval recesses 134 formed in and circumferentially spaced about an external enlarged flange portion 135 around the mounting sleeve 120. The portions of the cup rings 131 which carry the ring seals 133 fit closely against the upper and lower edges of the flange 135 while the rings 131 of the upper and lower packer cups extend toward each other over the flange 135 sufficiently to permit the pins 132 of the upper and lower cup mounting rings to fit into the oval recesses 134. The circumferentially spaced oval recesses 134 and pins 132 are used to interlock the packer cups in the packer cup mounting sleeve 120 so that no relative longitudinal motion may occur between the packer cups and the mounting sleeve and most importantly to prevent rotation of the mounting sleeve 120 within the packer cups so that the assembly L will resist any tendency to rotate due to the operation of the centrifugal pump. The seal ring portions 130 of the packer cups are sized to effect an interference fit with the innerwall surface of the tubing casing 10 which is sufficiently tight both to provide a liquid seal and to resist any turning effect of the centrifugal pump. The interlock thus provided by the pins 132 with the body structure of the assembly L will prevent rotation of the assembly relative to the packer cups.

The upper end of the packer cup mounting sleeve 120 fits into an annular packing retainer 140 which provides a longitudinally slidable coupling between the mounting sleeve 120 and the upper end of the mandrel 40 and the top sub 51. The retainer 140 and the sleeve 120 are interlocked by a retainer wire 141 which extends within internal annular aligned recesses in the retainer 140 and the sleeve 120. The retainer wire 141 has one bent end 142 which projects into a radial slot 143 in the sleeve 120. The details of the connection between the sleeve 120, the retainer 140, the mandrel 40, and the top sub 51 are better seen in FIGS. 4 and 6. The use of such a retainer wire is a standard technique for coupling together concentric tubular members for locking the members against longitudinal movement relative to each other.

Figure 6:
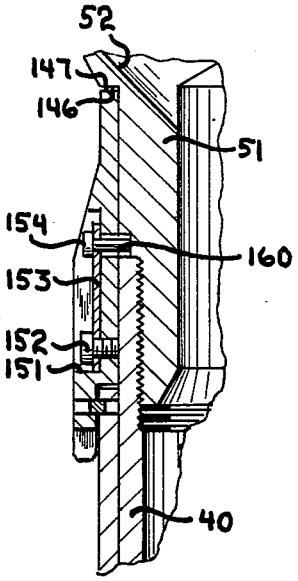
FIG. 6 is a fragmentary view in section of the shear pin structure shown in FIG. 4 with the shear pins in operating position holding the assembly locked in a well as illustrated in FIG. 2.
Figure 5:
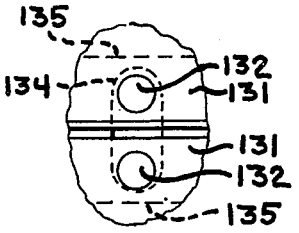
FIG. 5 is a fragmentary view in elevation of one of the coupling pin and slot arrangements between the annular seals and the assembly outer sleeve for holding the seals against rotation on the assembly.

In order for the central mandrel 40 along with the bottom and tub subs 42 and 51 of the assembly L to shift as a unit longitudinally within the keys 81, the key retainer sleeve 60, the packer cup mounting sleeve 120 and the packer cups 121, it is necessary that the retainer 140 slide on the upper end portion of the mandrel 40 and the top sub 51. As previously described, the upper end of the mandrel 40 is secured against rotation with the top sub 51 by the circumferentially spaced set screws 53. As seen in FIGS. 3 and 4 the heads of the set screws 53 are each disposed in a longitudinal recess 142 in the retainer 140. The recesses 142 are elongated and somewhat oval in shape as best seen in FIGS. 2 and 3 to permit a sliding fit of the heads of the set screws 53 in the slots so that the mandrel and top sub may move longitudinally within the retainer 140 while being held against rotation relative to the retainer by the set screw heads. Four of the set screws 53 and the slots 142 in the retainer 140 are arranged circumferentially spaced 90° about the assembly. To releasably lock the top sub and mandrel against movement in the retainer and packer cup mounting sleeve when the collar lock and seal assembly L is locked in operating position in a well shear pin assemblies 150 are provided as shown in detail in FIGS. 4 and 6. Four of the shear pin assemblies are employed mounted in circumferentially spaced longitudinal oval slots 151 formed in the retainer 140. Each of the shear pin assemblies includes a cap screw 152 which holds one end of a shear pin spring 153. The free end of the shear pin spring supports a shear pin 154. The inward end portion of the shear pin 154 is insertable through a shear pin hole 155 in the retainer 140 and a blind shear pin hole 160 in the top sub 51. The shear pin hole in the retainer 140 and the shear pin hole in the top sub are misaligned longitudinally when the assembly L is in the release running condition of FIG. 3 and FIG. 4. When the assembly L is locked in operating position in a well the shear pin holes 155 and 160 are aligned longitudinally as shown in FIG. 6 so that each of the shear pins 154 may move inwardly to releasably lock the mandrel and top sub against longitudinal movement relative to the retainer 140. In the release condition of the assembly L as represented in FIG. 4 the inward end of the shear pin 154 engages and drags along the outer surface of the mandrel 40. The inward end of the shear pins slide along the mandrel surface until the assembly L is in the locked condition at which time the springs 153 force the inward ends of the shear pins into the shear pin holes 160 of the top sub locking the tool mandrel against movement relative to the retainer 140, the packer cups, the sleeve 60 and the locking keys 81. A sufficient lifting force on the tool string to force the mandrel and top sub upwardly to shear the pins 154 releases the assembly L for removal from a well. The assembly L may be fitted with as many shear pins 154 and shear pins of such a size as to control the release force required for removal of the assembly from a well. It will be understood, of course, that such force is mainly dependent upon the well pressure below the tool spring as the weight of the string will normally hold the tool string in a well with the assembly L in locked condition unless the well pressure below the assembly is sufficient to lift the tool string in which case there must be sufficient resistance by the shear pin 154 to hold the assembly L in the locked condition. Where it is not expected that there will be enough well pressure to require locking the assembly with the shear pins 154 only a single shear pin may be used to simply provide an indicator that the assembly is functioning properly and is in the locked condition in the well.

The bore 41 through the collar lock and the seal assembly L accommodates the shaft from the pump motor 14 extending to the pump P and also provides a central flow passage for well fluids which are pumped through the collar lock and seal assembly from the well below into the tubing above the tool spring.

In the operation of the collar lock and seal assembly L of the invention the assembly is connected into a tool train such as the train T shown in FIG. 1 which is to be releasably locked in a well bore. When using the arrangement of FIG. 1 to electrically pump fluids from a well bore the well will normally have been previously equipped with the landing nipple 30 and the mechanical valve 25 which is installed using conventional wireline techniques and apparatus. The tool train including the assembly L of the invention is then connected together at the surface and lowered through wellhead equipment of conventional design such as blow-out preventers and such other wellhead equipment as will permit insertion of the tool train cable into a well while maintaining safety conditions with respect to any pressure that might be in the well. When the collar lock and seal assembly L is connected into the tool train the assembly L is in the released running condition of FIGS. 3 and 4 at which the mandrel 40 and the key retainer sleeve 60 are pinned together by the shear pins 95 at relative longitudinal positions at which the mandrel locking surfaces 73 and 74 are aligned with the internal release recesses of the keys 81 so that the keys are free to move radially in the key windows 80. Of course, in this running condition of the assembly L the shear pin assembly 150 is as shown in FIG. 4 with the shear pins 154 engaging the outer surface of the upper end portion of the mandrel 40 since the shear pin holes 155 and 160 in the retainer 140 and the top sub 51 respectively are misaligned longitudinally. As the tool train is lowered in the well the loose condition of the keys 81 and the lower end tapered surfaces on the keys will generally keep the keys contracted to the release positions shown in FIG. 3. The tool train is lowered in the well tubing or casing 10 until the probe 24 enters the mechanical valve 25 opening the valve while simultaneously the collar lock and seal assembly L enters the pump shoe or landing nipple 15 with the lower end edge 61 of the key retainer sleeve 60 on the assembly L engaging the no-go shoulder 62 in the pump shoe. Because the surface 62 is a no-go shoulder the collar lock and seal assembly L cannot move further down the tubing 10 and comes to rest supported on the no-go shoulder of the pump shoe.

During the downward movement of the tool train in the well until the collar lock and seal assembly L comes to rest on the no-go shoulder 62 of the pump shoe 15, the shear pins 95 hold the assembly L in the release running position at which the external mandrel shoulder surface 105 is in contact with the internal key retainer sleeve flange 110 as shown in FIG. 3. The bypass ports 101 and 102 are aligned so that fluid passing upwardly in the tubing string around the assembly L may flow into the bore 41 through the bypass ports passing upwardly in the bore and back outwardly in the ports 52 of the top sub 51. The numerous previously described longitudinal flow passages along the mandrel and locking keys allow fluid around the assembly to freely flow up along the outer surfaces of the assembly. The tight interference fit of the packer cups 121 will not, however, permit this fluid around the assembly to flow past the cups and thus it is essential that it bypass the assembly L through the bypass ports flowing through the interior of the assembly mandrel and back out into the well tubing above the assembly L along the path described. As the tool train moves downwardly in the tubing the relatively short length of the assembly L and flexibility of the connecting flex joints 16, 21 and 23 allow the tool train to traverse bent and deviated pipe sections.

When the collar lock and seal assembly comes to rest on the no-go shoulder 62 in the pump shoe or landing nipple 15 sufficient weight of the tool train is placed on the collar lock and seal assembly by releasing the holding force on the cable C to shear the pins 95 which releases the bottom sub 42, the mandrel 40, and the top sub 51 to move downwardly in the key retainer sleeve 60, the packer cup retainer sleeve 120, and the packer retainer 140. The assembly of the bottom and top sub and the mandrel shifts downwardly due to the weight being placed on the assembly until the downwardly facing shoulder 146 on the top sub 51 engages the upper end edge 147 of the retainer 140 which is the lower limit of movement of the mandrel and bottom and top subs relative to the key retainer and packer support sleeve assembly. This downward movement of the mandrel shifts the mandrel locking flanges 73 and 74 downwardly within the keys 81 positioning the mandrel locking flanges within the thicker portions of the keys 81 locking the keys outwardly at expanded positions as shown in FIG. 2. With the keys so expanded and locked the assembly L cannot be lifted due to the interference between the upper end edges of the keys and the lower end edge 94 of the tubing section threaded into the pump shoe 15 and defining the upper end of the locking recess 92 in the pump shoe. As a practical matter it is relatively simple to generate sufficient downward force to shear the pins 95 for locking the assembly L in the well. A tool string as described and illustrated in FIG. 1 would generally weigh in the vicinity of 16,000–18,000 pounds and thus with that weight supported on the cable C it is only necessary to slack off on the cable to a minor extent to apply as much as 4,000 pounds to the assembly L for locking the keys 81 outwardly. It will be recognized that since the retainer sleeve 60 cannot move downwardly past the stop shoulder 62 and the locking keys 81 are disposed in the windows 80 so that the keys are limited longitudinally when the downward force is applied to the tool spring the only parts of the assembly L which can move downwardly are those including the mandrel 40 and the upper and lower subs 42 and 51 respectively. When the lower limit of movement of the mandrel 40 and the upper and lower subs is reached locking the keys 81 outwardly the bypass ports 101 and 102 are misaligned longitudinally as shown in FIG. 2 so that the ports 101 are at a lower position between the ring seals 103 and 104 thereby shutting off flow between the ports 101 and 102 so that the bypass through the assembly L is closed. When the lower limit of movement of the mandrel and subs is reached at the time of contact of the upper sub shoulder 146 with the retainer shoulder 147, the shear pin recess 160 in the top sub 151 is aligned with the shear pin hole 155 in the retainer 140. The spring 153 associated with each of the shear pins 154 being employed forces the shear pin inwardly from the position shown in FIG. 4 to the position shown in FIG. 6 so that the mandrel and bottom and top subs are shear pinned against longitudinal movement relative to the key retainer sleeve 60 and the packer cup support sleeve 120. The action of the shear pins 154 thus releasably locks the collar lock and seal assembly L at the operating position represented in FIG. 2. Since the shear pins 154 prevent the mandrel 40 from moving back upwardly the locking ribs or flanges on the mandrel remain behind the keys 81 so that the keys 81 remain locked outwardly.

After the collar lock and seal assembly L is believed by the operator of the system to have been landed and locked as described, the locking may be tested by applying an upward force which is sufficiently in excess of the weight of the system to lift the tool train with a force which is slightly less than the holding capacity of the shear pins 154. If the tool train does not pull back out of the shoe 15 when so tested, it may be reasonably assumed that the train is properly locked. In view of the substantial weight of the tool train it may not be necessary in wells which have either very low pressure or no pressure to use several of the shear pins 154 inasmuch as there will be essentially no force within the well below the tool train trying to lift the train from the well. Under such circumstances, however, it is still a good practice to use at least one of the shear pins 154 to serve as an indicator of proper locking of the collar lock and seal assembly L at the pump shoe. Under such circumstances in the event that system does not properly function and there is a question on the part of the operator as to why it is not functioning, the tool train may be pulled from the well and if the shear pin 154 has been sheared, which can readily be determined by examination of the assembly, it will at least be known that one of the problems was not whether or not the assembly L was properly locked in the shoe 14. The finding of the shear pin 154 as having been sheared will be an indicator that the assembly has been landed and properly locked.

With the tool train satisfactorily landed and locked in the tubing the pump P may be started to pump liquids from the well. When the pump is turned on the discharge pressure of the pump causes the hydraulic valve 20 to open as previously discussed so that the pump may pull liquids through the open mechanical valve 25 which is held at the open position by the probe 24, through the hydraulic valve 20, and discharge the liquids upwardly through the bore of the assembly L around the shaft 31 of the pump driving motor 14. The pump fluids pass outwardly from the bore 41 through the ports 52 in the top sub 51 flowing upwardly within the tubing 10 around the pump motor 14 and the cable C to the surface. The packer cups 121 engage the walls of the tubing 10 sufficiently tightly to prevent fluid flow along the annulus within the tubing around the assembly 10 from either below the assembly or above the assembly. Additionally, the packer cups 121 engage the tubing wall sufficiently tightly to resist the tendency of the hydraulic pump particularly during start-up to turn the collar lock and seal assembly L within the tubing. Prevention of turning of the assembly is desired to avoid damage due to twisting to the cable C. While obviously the length of cable necessary to reach the tool string from the surface can tolerate twisting certainly to the extent of one turn, it would be damaged by a large number of twists. The twisting effect applied by the pump to the bottom sub 42 is transmitted to the mandrel 40 where the twisting is resisted by the set screws 71 engaged in the longitudinal slots 69 extending along the outer surface of the mandrel. The set screws 71 are fixed in the key retainer sleeve 60 which is tightly screwed to the packer cup mounting sleeve 120 which cannot turn because of the engagement of the pins 132 in the slots 134 of the sleeve 120 which holds the sleeve against rotation because the packer cups are tightly engaged with the inner wall surface of the tubing 10. Even if there is a tendency to unthread the connection between the sleeve 60 and the sleeve 120, the fact that the upper end of the sleeve 120 is effectively connected with the top sub 51 through the retainer 140 and the set screws 53 would preclude any more than a minor amount of unthreading so that only a small amount of twisting could possibly occur. With the threads between the sleeves 60 and 120 made up sufficiently tight before installation such a tendency to slightly rotate will generally not occur.

When release of the tool train and removal from the well tubing is desired it is necessary to unlock the collar lock and seal assembly L. A sufficient upward force is applied to the cable C in excess of the weight of the cable and the tool train to apply a force which exceeds the shear strength of the shear pins 154. The upward force applied to the assembly L at the top sub 51 tends to move the top sub along with the mandrel 40 and the bottom sub upwardly relative to the retainer sleeve 60 and the packer cup sleeve 120 which are held against upward movement by the expanded locking dogs 81 which engage the downwardly facing tubing edge surface 94 holding the assembly L against upward movement. When the shear pins 154 are sheared the top and bottom subs along with the mandrel 140 are pulled upwardly until the shoulder surface 105 on the mandrel engages the internal flange 110 within the key retainer sleeve 60. The upward movement of the mandrel realigns the mandrel expander surfaces 73 and 74 with the internal key recesses along the thin portions of the keys 81 so that the keys may collapse inwardly around the mandrel in the windows 80 releasing the assembly L from the locking recess at the pump shoe. The upward movement of the mandrel also realigns the ports 101 and 102 in the mandrel and the sleeve 60 respectively so that a bypass flow passage is again provided in the assembly L allowing fluid flow in the well around the packer cups as the tool train is lifted upwardly in the well. The parts of the assembly L including the keys 81 in the windows 80, the key retainer sleeve 60, the packer cup sleeve 120 with the packer cups 121, along with the mandrel 40 and subs, shift to the relative positions shown in FIG. 3 with the set screws 53 being disposed at the upper ends of the slots 142 in the retainer 140 which represents the full release position of the parts of the assembly L. In this condition of the tool, as previously described, the locking keys 81 may move fully inwardly so that the assembly is fully released and permits removal of the tool train from the well bore.

It will now be understood that a new and improved collar lock and seal assembly has been described which will effectively lock well tools including such well pumps in a well bore at a landing nipple locking recess. The tool of the invention is fully operable by application of longitudinal forces only and essentially resists rotational forces of the well tools coupled with the lock and seal assembly while sealing around the assembly against pressures from both above and below the assembly in a well bore. The bypass capability permits insertion into a liquid filled closed system even with the lower end of the tool train plugged.

What is claimed is:

1. A collar lock and seal assembly for releasably engaging a flow conductor inner wall and sealing with said wall comprising: a body mandrel; seal means on said body mandrel for sealing around said mandrel with said flow conductor wall surface; locking key means on said body mandrel supported for radial expansion and contraction between the locking and release positions; a locking key retainer sleeve mounted for sliding movement on said mandrel supporting said key means, said retainer sleeve being provided with a no-go shoulder surface for engagement with a support surface along said flow conductor; and means on said mandrel and within said key means permitting said key means to collapse inwardly to said release position at a first relative longitudinal position of said mandrel within said retainer sleeve and for holding said key means outwardly at said locking position at a second relative longitudinal position of said mandrel within said retainer sleeve.

2. A collar lock and seal assembly in accordance with claim 1 including means between said retainer sleeve and said mandrel for releasably locking said mandrel at said first relative position within said retainer sleeve.

3. A collar lock and seal assembly in accordance with claim 2 including means between said mandrel and said retainer sleeve for releasably locking said mandrel at said second longitudinal position within said retainer sleeve.

4. A collar lock and seal assembly in accordance with claim 3 wherein said seal means is connected with said retainer sleeve.

5. A collar lock and seal assembly in accordance with claim 4 including means providing a bypass valve between the interior and the exterior of said assembly, said valve being adapted to open at said first relative position of said mandrel in said retainer sleeve and close at said second relative position of said mandrel in said retainer sleeve.

6. A collar lock and seal assembly in accordance with claim 4 including means between said mandrel and said retainer sleeve for restraining said mandrel against rotation within said retainer sleeve.

7. A collar lock and seal assembly in accordance with claim 6 including a bypass valve opening through said retainer sleeve and said mandrel between the interior and the exterior of said assembly, said valve being adapted to open at said first relative position of said mandrel in said sleeve and to close at said second relative position of said mandrel in said sleeve.

8. A collar lock and seal assembly in accordance with claim 7 including means between said seal means and said retainer sleeve for restraining rotation of said retainer sleeve relative to said seal means.

9. A collar lock and seal assembly in accordance with claim 8 including means on opposite ends of said mandrel for connection of said assembly in a tool train adapted to be moved through a flow conductor.

10. A collar lock and seal assembly in accordance with claim 9 wherein said mandrel is provided with a central flow passage extending throughout the full length of said mandrel and side port means at one end of said mandrel communicating into said central flow passage.

11. A collar lock and seal assembly in accordance with claim 10 wherein said mandrel and said key means are provided with longitudinal external recesses to permit fluid flow along the exterior of said assembly as said assembly is transported along a flow conductor.

12. A collar lock and seal assembly for releasable engagement in a flow conductor at a no-go shoulder and locking recess along said flow conductor and sealing with the inner wall surface of said flow conductor, said assembly comprising: a tubular mandrel having a bore extending therethrough providing a central flow passage through said mandrel, said mandrel being provided with external longitudinally spaced transverse locking bosses; a tubular locking key retainer sleeve disposed around said mandrel provided with circumferentially spaced locking key windows positioned along said external locking bosses on said mandrel, said key retainer sleeve having a no-go support shoulder on one end thereof for engaging said no-go shoulder in said flow conductor to support said assembly in said flow conductor; a locking key disposed in each of said windows of said retainer sleeve, each of said locking keys having edge retainer flanges extending between said retainer sleeve and said mandrel to retain said keys in said windows as said mandrel moves within and relative to said retainer sleeve, each of said locking keys having internal transverse spaced locking surfaces and release recesses, said release recesses adapted to be aligned with said locking surfaces on said mandrel at a first position of said mandrel within said sleeve to permit said keys to move inwardly to release positions and said locking surfaces being aligned to receive said locking surfaces on locking bosses on said mandrel at a second longitudinal position of said mandrel in said retainer sleeve holding said locking keys outwardly at locking positions; means providing a bypass port in said mandrel opening through a side wall of said mandrel into said central bore of said mandrel; means providing a bypass port in said retainer sleeve opening through said retainer sleeve to the interior thereof; said bypass port in said mandrel and said bypass port in said retainer sleeve being aligned at said first position of said mandrel in said retainer sleeve to provide a bypass flow passage from between the interior and exterior of said assembly; said bypass port in said mandrel and said bypass port in said retainer sleeve being misaligned at said second position of said mandrel in said retainer sleeve precluding bypass flow between the interior and exterior of said assembly; means providing seals between said mandrel and said retainer sleeve on opposite sides of one of said bypass ports to insolate one of said bypass ports from the other of said bypass ports when said mandrel is at said second position in said retainer sleeve; means providing a stop shoulder on said mandrel and means providing a stop shoulder within said retainer sleeve, said stop shoulders being engageable one with the other when said mandrel is at said first position in said retainer sleeve limiting the relative movement of said mandrel in one direction in said retainer sleeve; a packer cup support sleeve disposed around said mandrel and connected with a second opposite end of said retainer sleeve; external annular packer cup means on said support sleeve for engaging and forming a fluid tight seal with an inner wall of said flow conductor around said assembly; a packer retainer connected with said support sleeve; means on said mandrel providing a stop shoulder engageable by said packer retainer limiting movement of said mandrel in said retainer sleeve at said second position of said mandrel; releasable means connected between said mandrel and said retainer sleeve for releasably locking said mandrel in said retainer sleeve at said first position of said mandrel at which said locking keys are free to move radially inwardly and outwardly; and releasable means between said mandrel and said support sleeve for releasably locking said mandrel against movement at said second position of said mandrel relative to said retainer sleeve.

13. A collar lock and seal assembly in accordance with claim 12 including means between said mandrel and said retainer sleeve for restraining rotation of said mandrel within said retainer sleeve and means between said packer cup means and said support sleeve for restraining rotation of said support sleeve within said packer cup means.

14. A collar lock and seal assembly in accordance with claim 13 wherein said rotation restraining means between said mandrel and said retainer sleeve includes a longitudinal slot along said mandrel and a set screw through said retainer sleeve projecting into said longitudinal slot.

15. A collar lock and seal assembly in accordance with claim 14 wherein said releasable means between said mandrel and said retainer sleeve comprises shear screw means engaged between said mandrel and said retainer sleeve and adapted to shear at a predetermined force applied to said mandrel when said retainer sleeve seats on said no-go shoulder in said flow conductor and said releasable means between said mandrel and said packer retainer comprises spring biased shear pin means activated to engage said mandrel at said second position of said mandrel in said retainer sleeve and adapted to release said mandrel for movement relative to said retainer sleeve upon application of a predetermined force for moving said mandrel from said second position in said retainer sleeve back to said first position to release said assembly from a locked condition in said flow conductor.

* * * * *

UNITED STATES PATENT AND TRADEMARK OFFICE

CERTIFICATE OF CORRECTION

PATENT NO. : 4,121,659

DATED : October 24, 1978

INVENTOR(S) : Donald F. Taylor

It is certified that error appears in the above-identified patent and that said Letters Patent are hereby corrected as shown below:

| | |
|---|---|
| Column 4, line 45 | cancel "device" and insert --drive--. |
| Column 4, line 47 | cancel "to" and insert --at--. |
| Column 7, line 20 | cancel "of" (second occurrence) and insert --or--. |

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*